US005137382A

United States Patent [19]

Miyajima

[11] Patent Number: 5,137,382

[45] Date of Patent: Aug. 11, 1992

[54] INKING DEVICE FOR A THERMAL PRINTER

[75] Inventor: Kunio Miyajima, Tokyo, Japan

[73] Assignee: NEC Corporation, Tokyo, Japan

[21] Appl. No.: 798,702

[22] Filed: Nov. 29, 1991

[30] Foreign Application Priority Data

Nov. 29, 1990 [JP] Japan ..... 2-331511

[51] Int. Cl.[5] ..... B41J 31/16

[52] U.S. Cl. ..... 400/202.4; 400/198; 400/202; 400/202.1

[58] Field of Search ..... 400/197, 198, 200, 201, 400/202, 202.1, 202.2, 202.3, 202.4

[56] References Cited

U.S. PATENT DOCUMENTS 1,393,637 10/1921 Ohashi ..... 400/202.4
3,951,253 4/1976 Tibay et al. ..... 400/202.1
4,091,914 5/1978 Stipanuk ..... 400/202.4
4,741,639 5/1988 Fausto et al. ..... 400/202.4
5,048,986 9/1991 Czesnik et al. ..... 400/202

FOREIGN PATENT DOCUMENTS 65687 4/1983 Japan ..... 400/198
95171 6/1984 Japan ..... 400/198

*Primary Examiner*—Edgar S. Burr
*Assistant Examiner*—J. R. Keating
*Attorney, Agent, or Firm*—Foley & Lardner

[57] ABSTRACT

An inking device for a thermal printer includes a hollow cylindrical inking roller made of a porous material and having a bladed wheel at the bottom of the cylindrical inking roller. The cylindrical inking roller supplies ink to an ink ribbon which contacts the outer periphery of the inking roller. A hollow cylindrical receptacle, for storing thermally fusible ink, is surrounded by the inking roller and has an opening at the top and apertures at the bottom for the egress of ink. A heater is provided for heating the receptacle. The receptacle has an axis deviated from the axis of rotation of the inking roller.

5 Claims, 2 Drawing Sheets

INKING DEVICE FOR A THERMAL PRINTER

BACKGROUND OF THE INVENTION

The present invention relates to an inking device for a printer and, more particularly, to an inking device applicable to a thermal transfer type printer having a thermal head and an ink ribbon.

A thermal transfer type printer prints images on plain paper sheets by using an ink ribbon having a film to which thermally fusible ink is applied. This kind of ink ribbon, however, has to be discarded and replaced with another when used once, incurring a cost for replacing the ink ribbon.

In light of this, Japanese Patent Disclosure (Kokai) No. 11814/1980 proposes a thermal transfer type printer using reusable film and an inking roller which applies thermally fusible ink to part of the film that has been used. Specifically, this printer supplies ink to the inking roller on the basis of the surface tension of the ink. However, a prerequisite of such a convention scheme is that the viscosity of the ink be sufficiently low, which degrades the quality of printing. Should highly viscous ink be used to increase the printing quality, the supply of ink to the inking roller would be insufficient.

SUMMARY OF THE INVENTION

It is, therefore, an object of the present invention to provide an inking device for a thermal printer which is capable of supplying a sufficient amount of ink to an inking roller so as to supply a sufficient amount of ink to an ink ribbon.

An inking device for a thermal printer of the present invention includes a hollow cylindrical inking roller made of a porous material and having a bladed wheel at the bottom of the cylindrical inking roller. The cylindrical inking roller supplies ink to an ink ribbon which contacts the outer periphery of the inking roller. A hollow cylindrical receptacle, for storing thermally fusible ink, is surrounded by the inking roller and has an opening at the top and apertures at the bottom for the egress of ink. A heater is provided for heating the receptacle. The receptacle has an axis deviated from the axis of rotation of the inking roller.

BRIEF DESCRIPTION OF THE DRAWINGS

The above and other objects, features and advantages of the present invention will become more apparent from the following detailed description taken with the accompanying drawings in which.

DETAILED DESCRIPTION OF THE PREFERRED EMBODIMENT

Figure 1:
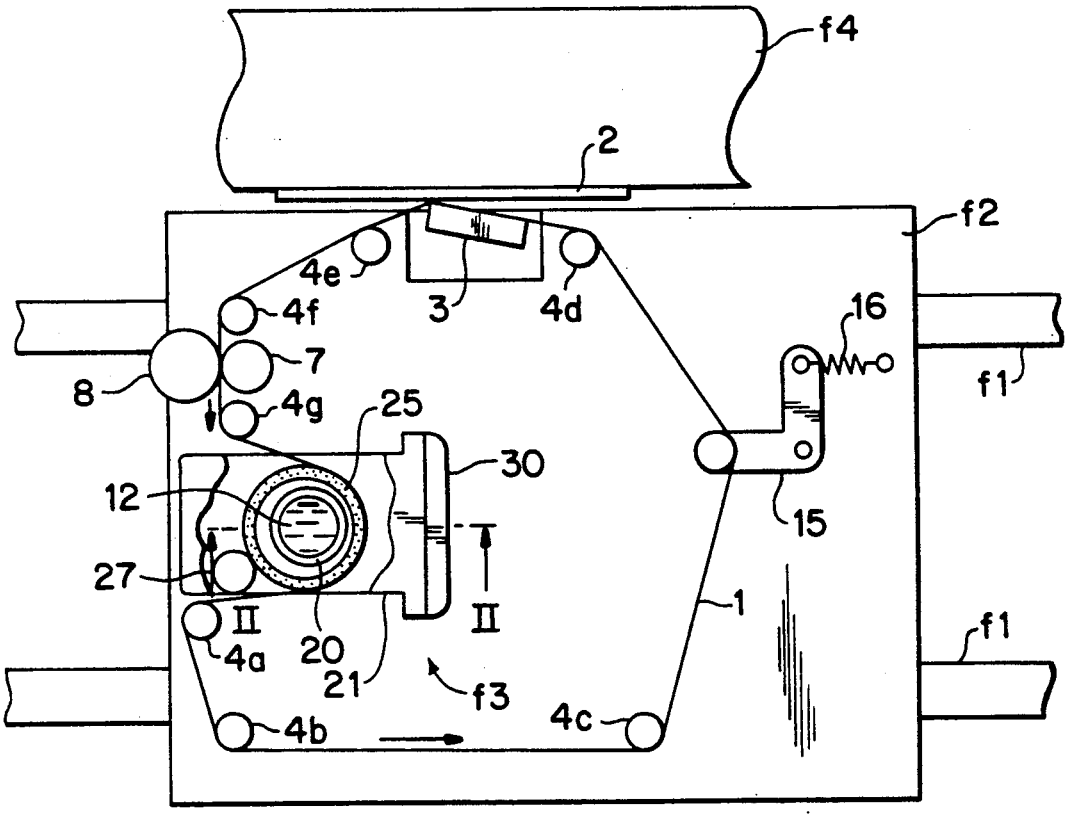
FIG. 1 is a plan view of a thermal transfer type printer embodying the present invention.

Referring to FIG. 1 of the drawings, a thermal transfer type printer embodying the present invention includes a carriage 52. The carriage 52 is mounted on and slidable along parallel guide shafts 51 in a reciprocating motion. A thermal head 3 and an inking unit 53 are mounted on the carriage 52. An ink ribbon 1 has a reusable film base 11 (FIG. 5) which is resistive to heat. Thermally fusible ink 12 (FIG. 5) is applied to the outer surface of the reusable film base 11. The ink 12 is implemented as a mixture of wax, resin and carbon black.

A recording medium in the form of a sheet 2 is wrapped around a platen 54. The thermal head 3 contacts the sheet 2 along the edge thereof where heating elements are positioned. The ink ribbon 1 is passed over guide rollers 4*a*–4*g*. A capstan roller 7 is rotated by a drive source, not shown, to transport the ink roller 1 in the direction indicated by an arrow together with a pinch roller 8. A tension arm 15 is constantly biased by a spring 16 to exert an adequate degree of tension on the ink ribbon 1, thereby preventing the ribbon 1 from being dislocated in the widthwise direction.

Figure 2:
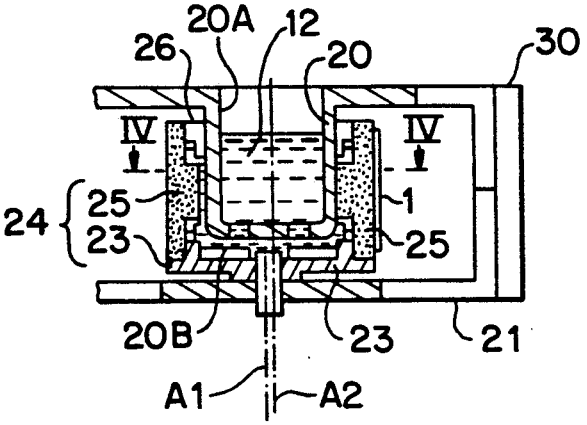
FIG. 2 is a sectional view taking along line II—II of FIG. 1.
Figure 3:
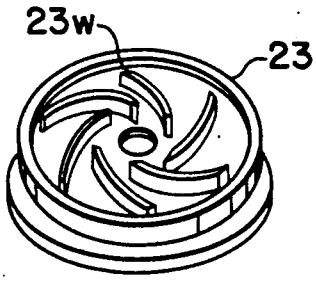
FIG. 3 is a perspective view of a bladed wheel included in the embodiment shown in FIG. 1.

As is shown in FIGS. 2 and 3, the inking unit 53 has a unit housing 21 in which a roller unit 24 is accommodated. The roller unit 24 is rotatable about an axis A1. A hollow cylindrical receptacle 20 is formed integrally with the unit housing 21 and filled with thermally fusible ink 12.

The roller unit 24 is made up of a bladed wheel 23 positioned at the bottom of the unit 24, and an inking roller 25 affixed to the bladed wheel 23. The ink 12 is fed from the inking roller 25 to the ink ribbon 1 which contacts the outer periphery of the roller 25. The receptacle 20 is surrounded by the inking roller 25 and has an opening 20A at the top and apertures 20B at the bottom. The receptacle 20 has an axis A2 which is deviated from the axis A1 of the roller unit 24. Specifically, when the inside diameter of the roller 25 is 12 millimeters and the receptacle 20 has an outside diameter of 11 millimeters, the deviation of the axis A2 from the axis A1 is selected to be 1 millimeter. In general, the outside diameter of the receptacle 20 is about 90% of the inside diameter of the inking roller 25. The deviation of the axis A1 and A2 is advantageously set at about 5–20% of the inside diameter of the roller 25. For example, the outside diameter of the receptacle 20 and the inside diameter of the roller 25 are in a range from 8 to 45 mm, and a range from 10 to 50 mm, respectively.

A subinking roller 27 is located at the side of the roller 25 where the ink ribbon 1 leaves the roller 25, i.e., downstream of the roller 25 with respect to the moving direction of the ribbon 1. The subinking roller 27 is in contact with the surface of the ink ribbon 1 that carries the ink thereon.

The unit housing 21 and cylindrical receptacle 20 are made of aluminum or similar metal having high heat condutivity. A heater 30 is affixed to one side of the unit housing 21 and maintained at a predetermined temperature slightly higher than the melting point of the ink 1. The heater 30, therefore, melts the solid ink down to liquid ink and maintains the ink 12 in the receptacle 20 in a liquid state.

As shown in FIG. 3, the bladed wheel 23 has blades 23*w* which extend radially outward in a spiral configuration. The inking roller 25 is porous and produced by sintering the powder of stainless steel or bronze. The roller 25 has pores for passing particles whose diameter is as small as about 20 microns to about 100 microns. A bush 26 is affixed to the outer periphery of the receptacle 20 at the top of the roller unit 24. The roller unit 24 is rotatable around the receptacle 20.

In operation, a control circuit, not shown, sends a drive signal to the thermal head 3. In response, the thermal head 3 generates heat to heat a part of the ink ribbon 1. As a result, the ink 12 is transferred from the ink ribbon 1 to the recording sheet 2. At this instant, the carriage 52 moves in a predetermined printing direction (to the right as viewed in FIG. 1) along the guides 51. The ink ribbon 1 is driven by the capstan roller 7 in a direction indicated by an arrow in FIG. 1. The ink ribbon 1 having locally lost the ink 12 due to the operation of the head 3 is transported to the inking unit 53 via the guide rollers 4*e*, 4*f* and 4*g*.

Figure 4:
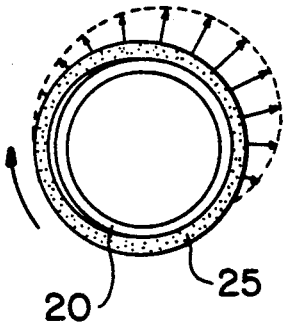
FIG. 4 is a sectional view taking along line IV—IV of FIG. 2.

In the inking unit 53, the inking roller 25 rotates along with the movement of the ink ribbon 1 since the latter is wrapped around the former. The ink 12 held in a liquid state in the receptacle 20 flows down onto the bladed wheel 23 via the apertures 20B formed through the bottom of the receptacle 20. Since the bladed wheel 23 is rotating together with the roller 25, the ink 12 is sequentially fed to the gap between the roller 25 and the receptacle 20 by the spiral blades 23*w*. The axis A1 of rotation of the roller unit 24 is deviated from the axis A2 of the receptacle 20, as stated earlier. As a result, the ink 12 is forced out of the roller 25 particularly at the portion contacting the ink ribbon 1 due to the change in pressure distribution, as shown in FIG. 4.

Figure 5:
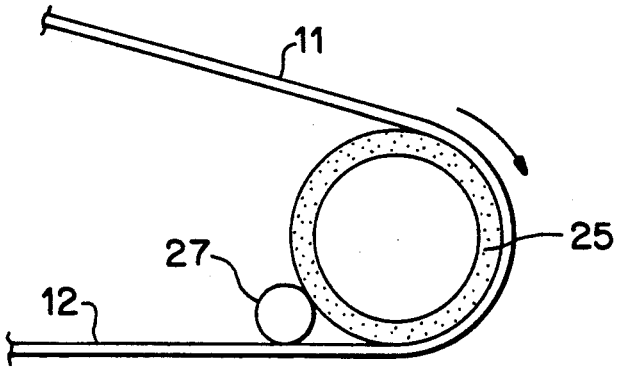
FIG. 5 is a plan view showing an operation of the embodiment shown in FIG. 1.

The ink 12 applied to the ink ribbon 1 by the inking roller 25 forms a layer which is not uniform in thickness, since the surface of the roller 25 is not smooth. The subinking roller 27 has a smooth surface and is heated by the heater 30. The subinking roller 2 rubs against the surface of the ink layer formed on the ink ribbon 1 to thereby provide the ink layer with a uniform thickness, as shown in FIG. 5.

In summary, it will be seen that the present invention provides an inking device for a printer which is capable of supplying a sufficient amount of ink to an ink ribbon at all times. This advantage is derived from the fact that a hollow cylindrical ink receptacle has an axis deviated from the axis of rotation of an inking roller. Such a deviation changes the internal pressure distribution and thereby forcibly supplies ink to the ink roller.

Various modifications will become possible for those skilled in the art after receiving the teachings of the present disclosure without departing from the scope thereof.

What is claimed is:

1. An inking device for a printer, comprising:

a hollow cylindrical inking roller made of a porous material and having a bladed wheel at the bottom of said cylindrical inking roller for supplying ink to an ink ribbon which contacts an outer periphery of said inking roller;

a hollow cylindrical receptacle surrounded by said cylindrical inking roller and having an opening at the top of said cylindrical receptacle and apertures for the egress of ink; and a heater for heating said receptacle;

said receptacle having an axis deviated from an axis of rotation of said inking roller.

2. An inking device as claimed in claim 1, further comprising a subinking roller located at the side of said inking roller where said ink ribbon leaves said inking roller and contacting the surface of said ink ribbon on which said ink is deposited.

3. An inking device as claimed in claim 1, wherein said axis of said receptacle deviates from said axis of rotation of said inking roller by an amount ranging from 5% to 20% of an inside diameter of said cylindrical inking roller.

4. An inking device as claimed in claim 1, wherein an outside diameter of said cylindrical receptacle is about 90% of said inside diameter of said inking roller.

5. An inking device for a printer, comprising:

a hollow cylindrical inking roller made of a porous material and having a bladed wheel at the bottom of said cylindrical inking roller for supplying ink to an ink ribbon which contacts an outer periphery of said inking roller;

a hollow cylindrical receptacle surrounded by said inking roller and having an opening at the top of said cylindrical receptacle and apertures at the bottom of said cylindrical receptacle for the egress of ink; and a heater for heating said receptacles;

said receptacles having an axis deviated from an axis of rotation of said inking roller.

* * * * *